US009678462B2

(12) United States Patent
Kitagawa

(10) Patent No.: US 9,678,462 B2
(45) **Date of Patent: *Jun. 13, 2017**

(54) IMAGE FORMING APPARATUS AND CONTROL METHOD FOR FIXING DEVICE

(71) Applicants: KABUSHIKI KAISHA TOSHIBA, Tokyo (JP); TOSHIBA TEC KABUSHIKI KAISHA, Tokyo (JP)

(72) Inventor: Masaharu Kitagawa, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/185,269

(22) Filed: Jun. 17, 2016

(65) Prior Publication Data

US 2016/0320731 A1 Nov. 3, 2016

Related U.S. Application Data

(63) Continuation of application No. 14/702,331, filed on May 1, 2015, now Pat. No. 9,389,556.

(51) Int. Cl.
*G03G 15/20* (2006.01)

(52) U.S. Cl.
CPC ..... *G03G 15/2067* (2013.01); *G03G 15/2032* (2013.01); *G03G 15/2053* (2013.01)

(58) Field of Classification Search
CPC ..... G03G 15/2067; G03G 15/2053; G03G 15/2032
See application file for complete search history.

(56) References Cited

U.S. PATENT DOCUMENTS

| | | | |
|---|---|---|---|
| 2007/0025750 | A1 | 2/2007 | Ando |
| 2011/0170920 | A1 | 7/2011 | Fujiwara et al. |
| 2011/0222881 | A1 | 9/2011 | Yamada |
| 2014/0193181 | A1 | 7/2014 | Nakamura et al. |
| 2014/0356007 | A1 | 12/2014 | Kurokawa |

*Primary Examiner* — Rodney Bonnette
(74) *Attorney, Agent, or Firm* — Patterson & Sheridan, LLP

(57) ABSTRACT

An image forming apparatus according to an embodiment includes a fixing device, a transport unit and a controller. The fixing device includes a heat roller and a pressure roller that is moveable with respect to the heat roller. A movement mechanism moves the pressure roller among a contact position in which the pressure roller contacts the heat roller with a first pressing force, a separation position in which the pressure roller does not contact the heat roller, and a semi-contact position in which the pressure roller contacts the heat roller with a second pressing force smaller than the first pressing force. The transport unit transports a medium between the heat roller and the pressure roller. The controller controls the movement mechanism so that the pressure roller moves from the semi-contact position to the separation position after the pressure unit is in the semi-contact position for more than a predetermined time.

20 Claims, 6 Drawing Sheets

IMAGE FORMING APPARATUS AND CONTROL METHOD FOR FIXING DEVICE

CROSS-REFERENCE TO RELATED APPLICATION

This application is a continuation of co-pending U.S. patent application Ser. No. 14/702,331, filed on May 1, 2015, the entire contents of each of which are incorporated herein by reference.

FIELD

Embodiments described herein relate generally to an image forming apparatus including a fixing device which is able to change the pressing power of a pressure roller that comes in contact with a heat roller, and a control method for a fixing device thereof.

BACKGROUND

In the related art, an image forming apparatus includes a fixing device which is able to change a pressure of a pressure roller that comes in contact with a heat roller in a step-wise manner. By changing the pressure of the pressure roller, it is possible to modulate the heating amount applied to a recording medium.

When changing the pressure of the pressure roller, the pressure roller is separated from the heat roller, and the inter-axle distance between the pressure roller and the heat roller changes slightly. In a state in which the pressure roller is brought into contact with the heat roller, the pressure roller is pressed toward the heat roller by a spring or the like.

In the standby state in which recording media are not fed, the pressure roller is moved to a separation position not contacting the heat roller. Therefore, a mechanical operation sound is generated when the pressure roller is moved from the contact position to the separation position. In order to ensure the fixing capability in a color copy machine or the like with a high paper feed speed, the pressure applied by the pressure roller is set comparatively large. Thus, the load fluctuation between when contacting and when separating is large, and the operation sound is loud when the pressure roller is separated from the heat roller.

Thus, there is demand for the development of an image forming apparatus in which the operation sound of the fixing device is low.

DETAILED DESCRIPTION

An image forming apparatus according to an embodiment includes a fixing device, a transport unit and a controller. The fixing device includes a heat roller and a pressure roller that is moveable with respect to the heat roller. A movement mechanism moves the pressure roller among a contact position in which the pressure roller contacts the heat roller with a first pressing force, a separation position in which the pressure roller does not contact the heat roller, and a semi-contact position in which the pressure roller contacts the heat roller with a second pressing force smaller than the first pressing force. The transport unit transports a medium between the heat roller and the pressure roller. The controller controls the movement mechanism so that the pressure roller is at the semi-contact position in a standby state after a preheating operation of the fixing device is completed.

Various embodiments will be described hereinafter with reference to the accompanying drawings.

Figure 1:
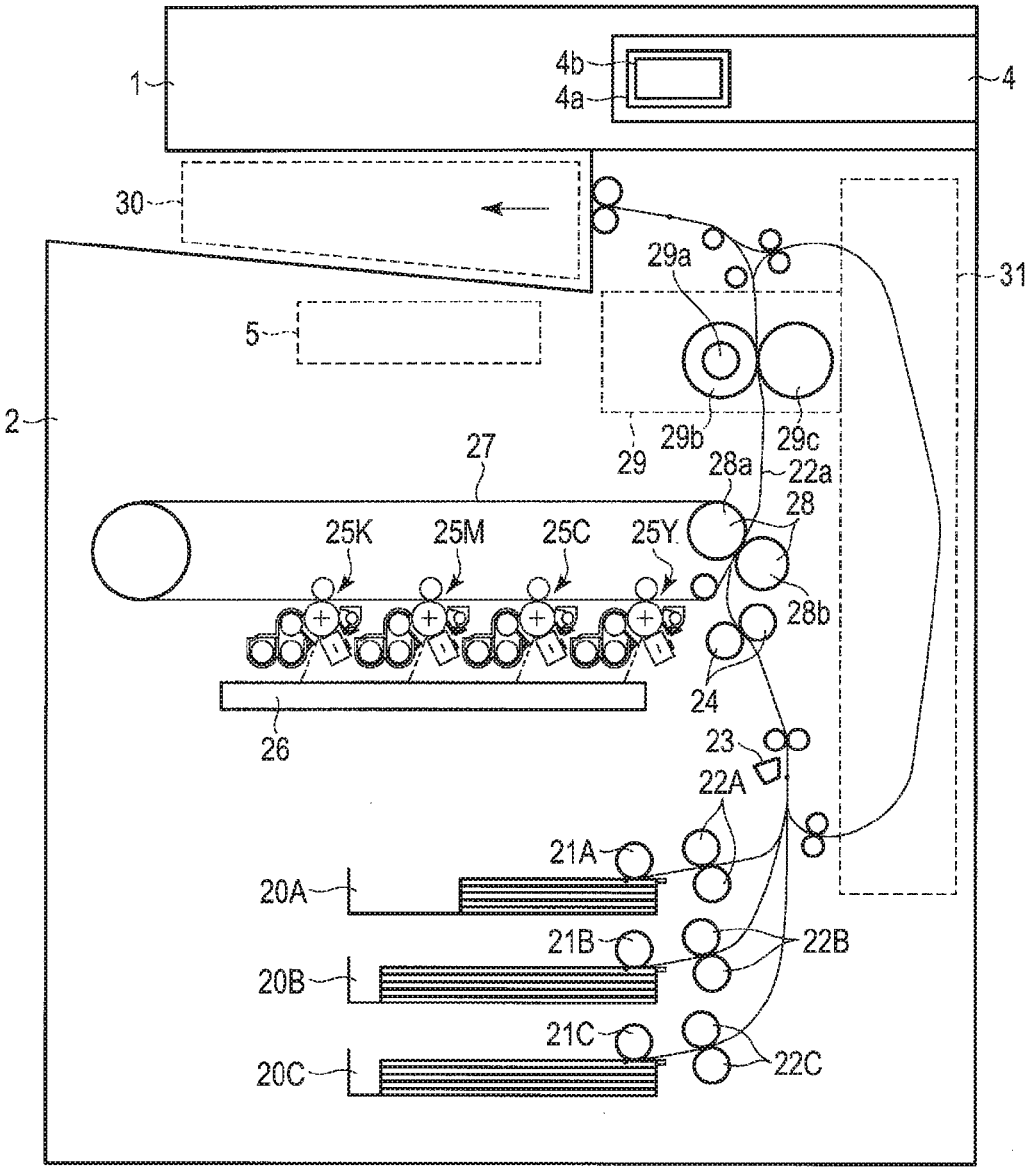
FIG. 1 is a schematic view illustrating an image forming apparatus according to an embodiment.

FIG. 1 is a schematic view illustrating a configuration example of an image forming apparatus according to an embodiment. The image forming apparatus may be, for example, a multi-functional peripheral (MFP). The image forming apparatus includes a scanner 1, a printer 2, an operation panel 4, and a system controller 5.

The scanner 1 reads an original image and converts the image to image data. The scanner 1, for example, includes a CCD line sensor that reads the image on the document reading surface and generates image data based on the read image. The scanner 1 may scan an original document placed on a document stand glass, or may read an image of a document transported by an automatic document feeding device (ADF, Auto Document Feeder). The scanner 1 includes a function (document detection function) that detects the size of the original document. The scanner 1, for example, may be disposed on the upper portion of the main body of the digital composite device. The scanner 1 is controlled by the system controller 5. The scanner 1 outputs the image data generated from the original document to the system controller 5.

The printer 2 forms an image on a sheet (image recording medium). The printer 2 includes a color printing function that prints a color image on a sheet, and a monochrome printing function that prints a monochrome (for example, black) image on a sheet. For example, the printer 2 is an electrophotographic image forming apparatus. The printer 2 forms a color image using a plurality of colors of toner (for example, three colors of yellow (Y), cyan (C), and magenta (M)). The printer 2 forms a monochrome image using a monochrome (for example, black) toner.

The printer 2 includes a plurality of paper cassettes 20A, 20B, and 20C (below, may be referred to collectively as paper cassette 20). The paper cassette 20 supplies the sheet on which an image is printed. The printer 2 may include a manual insertion tray as an additional feeding unit. For example, each of the paper cassettes 20A, 20B, and 20C is provided on the lower portion of the digital composite device main body in a detachable state. The paper cassettes 20A, 20B, and 20C accommodate different types of sheets (for example, different size and/or material).

Setting information, such as information relating to the sheets accommodated in each paper cassette 20, is stored in a non-volatile memory (for example, an NVM 54 described later). The printer 2 selects the paper cassette 20 accommodating the sheets used in the printing process according to the setting information. The printer 2 prints an image on the sheet fed from the selected paper cassette 20. When the printer 2 includes a manual insertion tray, the setting information with respect to the manual insertion tray may be stored in the nonvolatile memory similarly to each paper cassette 20.

Pick-up rollers 21A, 21B, and 21C (below, maybe collectively referred to as pick-up roller 21) are provided at the end portions of the sheet removing sides of each paper cassette 20A, 20B and 20C, respectively. The pick-up rollers 21A, 21B, and 21C remove the sheets one at a time from the respective paper cassettes 20A, 20B, and 20C. The pick-up roller 21 supplies the removed sheet to a transport path 22*a* (transport unit)which may include a plurality of transport rollers, or the like. The feeding unit is not limited to three paper cassettes and the pick-up rollers 21 as a feeding unit. For example, there may be one or two paper cassettes 20 and pick-up rollers 21, or there may be four or more.

The transport path 22*a* transports the sheet in the printer 2. The transport path 22*a* transports the sheet supplied by the pick-up rollers 21A, 21B, and 21C to a resist roller 24. The resist roller 24 transports the sheet to a transfer position at a timing that transfers an image to the sheet from an intermediate transfer belt 27. The transport path 22*a* transports the sheet to a nip between the heat roller 29*b* and the pressure roller 29*c* of the fixing device 29.

The image forming units 25Y, 25M, 25C, and 25K (below, may be collectively referred to as image forming unit 25), an exposure unit 26, the intermediate transfer belt 27, and the transfer unit 28 collectively function as an image forming unit that forms an image. The image forming unit 25 forms each color of transferred image on the sheet. In the configuration example illustrated in FIG. 1, the image forming unit 25Y forms an image with yellow toner. The image forming unit 25M forms an image with magenta toner. The image forming unit 25C forms an image with cyan toner. The image forming unit 25K forms an image with black toner. Each image forming unit 25Y, 25M, 25C, and 25K transfers each color of image to overlap on the intermediate transfer belt 27. In so doing, the color image is formed on the intermediate transfer belt 27.

The exposure unit 26 forms an electrostatic latent image on a photoreceptor drum (image support) of each image forming unit 25Y, 25M, 25C, and 25K with laser light. The exposure unit 26 irradiates the photoreceptor drum with laser light controlled according to the image data via an optical system such as a polygon mirror. The laser light from the exposure unit 26 forms an electrostatic latent image on the surface of each photoreceptor drum. The exposure unit 26 controls the laser light according to a control signal from the system controller 5. The electrostatic latent image formed on each photoreceptor drum is an image developed with each color of toner. For example, the exposure unit 26 controls the power of the laser light according to the control signal from the system controller 5. The exposure unit 26 also controls the modulation amount of a pulse width for controlling the emission of laser light according to the control signal from the system controller 5.

The image forming units 25Y, 25M, 25C, and 25K develop the electrostatic latent images formed on the respective photoreceptor drums with respective colors of toner. Each of the image forming units 25Y, 25M, 25C, and 25K forms a toner image (developer image) as a visible image on the photoreceptor drums. The intermediate transfer belt 27 is an intermediate transfer body. Each of the image forming unit 25Y, 25M, 25C, and 25K transfers (primary transfer) the toner image formed on the photoreceptor drum to the intermediate transfer belt 27. Each of the image forming units 25Y, 25M, 25C, and 25K imparts a transfer bias on the toner image at a primary transfer position. Each image forming unit 25Y, 25M, 25C, and 25K controls the transfer bias according to a transfer current. The toner image on each photoreceptor drum is transferred to the intermediate transfer belt 27 by a transfer bias at each primary transfer position. The system controller 5 controls the transfer current used by each image forming unit in the primary transfer processing.

Each of the image forming units 25Y, 25M, 25C, and 25K includes a sensor, such as a potential sensor and a density sensor. The potential sensor is a sensor that detects the surface potential of the photoreceptor drum. In each of the image forming units 25Y, 25M, 25C, and 25K, an electrostatic charger charges the surface of the photoreceptor drum before being exposed by the exposure unit 26. The system controller 5 is able to change the charging conditions with the electrostatic charger. The potential sensor detects the surface potential on the photoreceptor drum, the surface of which is charged by the electrostatic charger. The density sensor detects the density of the toner image transferred onto the intermediate transfer belt 27. The density sensor may detect the toner image formed on the photoreceptor drum.

For example, when forming a monochrome image, the image forming unit 25K transfers the toner image (visible image) developed with the black (monochrome) toner onto the intermediate transfer belt 27 (primary transfer). As a result, the intermediate transfer belt 27 holds the monochrome image formed with the black (monochrome) toner.

When forming a color image, each image forming unit 25Y, 25M, 25C, and 25K overlaps and transfers (primary transfer) the toner images (visible images) developed with each color (yellow, magenta, cyan, black) toner onto the intermediate transfer belt 27. As a result, the intermediate transfer belt 27 holds the color image in which each color of toner image is overlapped.

The transfer unit 28 transfers the toner image on the intermediate transfer belt 27 to a sheet at the secondary transfer position. The secondary transfer position is a position at which the toner image on the intermediate transfer belt 27 is transferred to the sheet. The secondary transfer position is a position at which the support roller 28*a* and the secondary transfer roller 28*b* are opposed. The transfer unit 28 imparts a transfer bias that is controlled according to a transfer current on the secondary transfer position. The transfer unit 28 transfers the toner image on the intermediate transfer belt 27 to a sheet with the transfer bias. The system controller 5 controls the transfer current used in the secondary transfer process.

The fixing device 29 fixes the toner image to the sheet through heat and pressure applied to the sheet. The fixing device 29 applies pressure as well as applying heat to the sheet in order to perform the fixing operation. The fixing device 29 includes a heat roller 29*b* with a heating unit 29*a* built in, and a pressure roller 29*c* that contacts the heat roller 29*b* in a pressurized state. The heat roller 29*b* includes belt-like rollers.

The heating unit 29*a* may be a temperature controllable heater. For example, the heating unit 29*a* may include a heater lamp, such as a halogen lamp, or may be an induction heating (IH) type heater. The heating unit 29*a* may include a plurality of heaters.

For example, when the toner image is fixed to the sheet, the system controller 5 controls the heating unit 29*a* so that the fixing device 29 is maintained at the fixing temperature or higher. The fixing temperature is a temperature at which a toner image formed on a sheet is able to be fixed. The fixing device 29 thus heats the sheet on which a toner image is transferred by the transfer unit 28 to the fixing temperature under pressure. In so doing, the fixing device 29 fixes the toner image to the sheet. The fixing device 29 transports the sheet on which the toner image is fixed to either a discharge unit 30 or an automatic duplexing device 31.

When the sheet fed from the fixing device 29 is discharged as is, the sheet is transported to the discharge unit 30. When also forming an image on the rear side of the sheet fed by the fixing device 29, the sheet is transported temporarily to the discharge unit 30 side, and subsequently switched back and transported to the ADU 31. In this case, the ADU 31 again supplies the sheet reversed by switchback to the transport path 22*a* before the resist roller 24.

The operation panel 4 is a user interface. The operation panel 4 includes a display unit 4*a* equipped with a touch panel 4*b*. The system controller 5 controls the content displayed on the display unit 4*a* of the operation panel 4. The operation panel 4 transmits information input to the touch panel 4*b* of the display unit 4*a* to the system controller 5. The user designates various operation modes on the operation panel 4, and inputs information, such as setting information. For example, the user selects a mode that executes printing on ordinary paper or a mode that executes printing on an envelope or thick paper via the operation panel 4. The operation panel 4 includes a power button 4*c* (FIG. 2).

Next, the configuration of the control system of the above-described image forming apparatus will be described.

Figure 2:
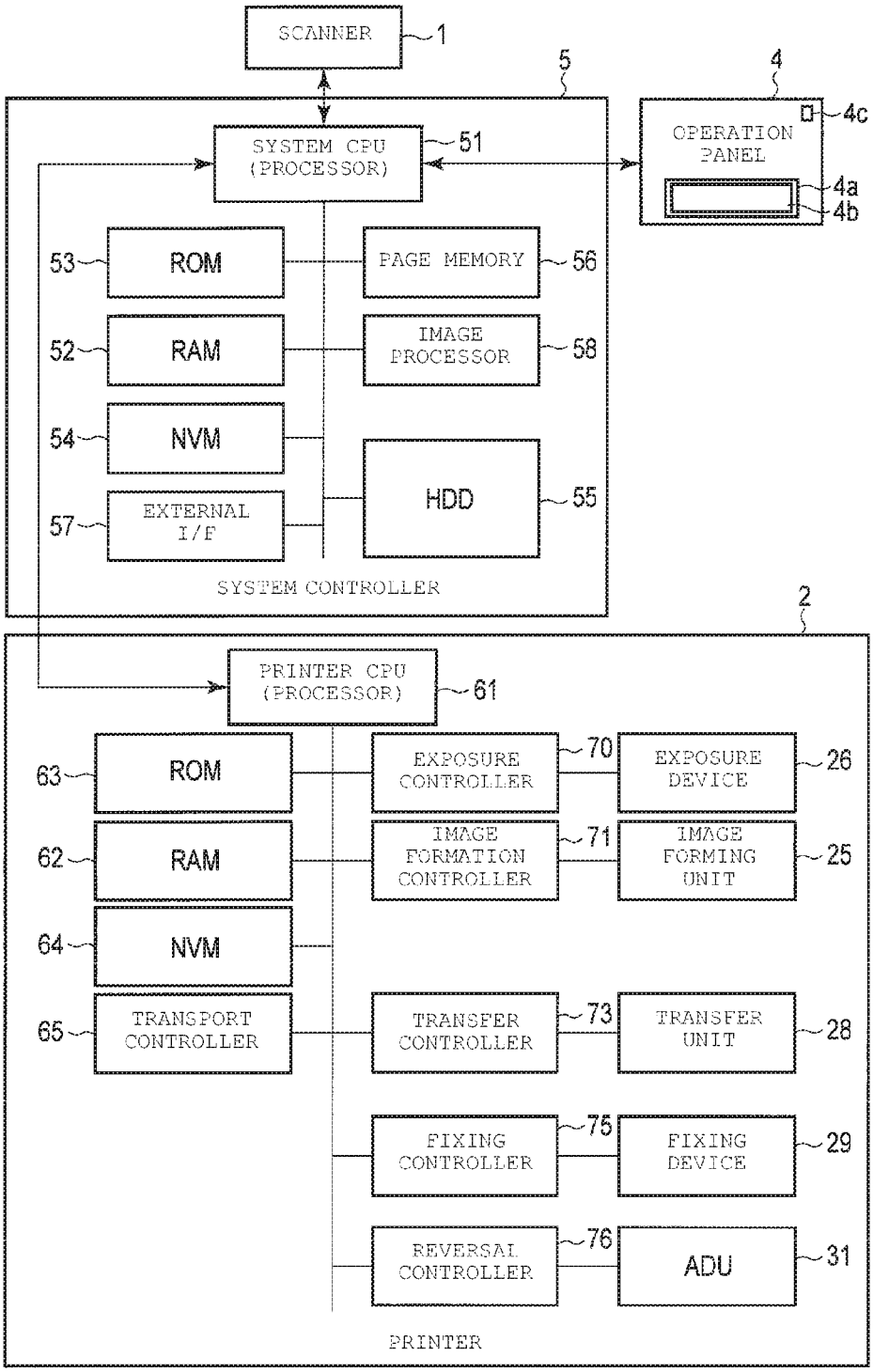
FIG. 2 is a block diagram illustrating a control system of the image forming apparatus.

As illustrated in FIG. 2, the system controller 5 includes a system CPU (processor) 51, a RAM 52, ROM 53, a nonvolatile memory (NVM) 54, an HDD 55, a page memory 56, an external interface (I/F) 57 and an image processor 58.

The system CPU 51 integrally controls the overall image forming apparatus, and each controller. The system CPU 51 is a processor that executes processes through executing programs. The system CPU 51 is connected to each controller in the apparatus via a system bus. The system CPU 51 is also connected to not only each portion in the system controller 5, but also to the controllers such as the scanner 1, the printer 2, and the operation panel 4 via the system bus. The system CPU 51 outputs operation instructions to each controller, and acquires a variety of information from each controller through bidirectional communication with the scanner 1, the printer 2, and the operation panel 4. The system CPU 51 receives information indicating the detection signal and the operation state of various sensors disposed at each portion in the apparatus.

The RAM 52 includes a volatile memory. The RAM 52 functions as a working memory or a buffer memory. The ROM 53 is a non-rewritable nonvolatile memory that stores programs and control data or the like. The system CPU 51 executes various processes through executing programs stored in the ROM 53 (or a nonvolatile memory 54 and an HDD 55) while using the RAM 52.

The nonvolatile memory (NVM) 54 is a rewritable nonvolatile memory. The NVM 54 stores the control program executed by the system CPU 51 and control data. The NVM 54 stores a variety of setting information and processing conditions. For example, the NVM 54 stores the setting information with respect to the type of medium (ordinary paper, envelope, thick paper or the like) fed.

The hard disk drive (HDD) 55 is a high capacity storage device. The HDD 55 stores image data and a variety of operation history information or the like. The HDD 55 may store control programs and control data or the like, or may store setting information and processing conditions.

The page memory 56 is a memory for expanding the image data that is the processing target. For example, when performing a copy process, the page memory 56 stores image data generated by the scanner 1 and subjected to image processing. The system CPU 51 subjects the image data stored in the page memory 56 to image processing for printing, and outputs the data to the printer 2. The CPU 51 may save the image data stored in the page memory 56 to the HDD 55 and sent the image data to an external apparatus via the external interface 57.

The external interface (I/F) 57 is an interface for communicating with an external apparatus. For example, the external interface 57 receives print data in accordance with a print request from the external apparatus. The external interface 57 may be an interface that transmits and receives data to the external apparatus, or may be a network interface for communicating via a network.

The image processor 58 includes functions such as a scanner system image processor that subjects the image data read by the scanner 1 to image processing, a compression and expansion unit that performs compression or expansion of the image data, and a printer image processor that generates printing image data the printer 2 prints on the sheet. For example, the scanner system image processor includes functions, such as shading compensation processing, gradation conversion processing, and inter-line correction processing.

Next, the control system in the printer 2 will be described.

As illustrated in FIG. 2, the printer 2 includes a printer CPU (processor) 61, a RAM 62, ROM 63, a nonvolatile memory (NVM) 64, a transport controller 65, an exposure controller 70, an image formation controller 71, a transfer controller 73, a fixing controller 75 (controller), a reversal controller 76, and the like. The printer CPU 61, RAM 62, and ROM 63 function as a controller.

The printer CPU 61 administers overall control of the printer 2. The printer CPU 61 is a processor that executes processes through executing programs. The printer CPU 61 is connected to each controller in the printer 2 via a system bus or the like. The printer CPU 61 outputs operation instructions to each controller in the printer 2 according to the operation instructions from the system CPU 51, and notifies the system CPU 51 of the variety of information acquired from each controller.

The RAM 62 includes a volatile memory. The RAM 62 functions as a working memory or a buffer memory. The ROM 63 is a non-rewritable nonvolatile memory that stores programs and control data or the like. The printer CPU 61 executes various processes through executing programs stored in the ROM 63 (or NVM 64) while using the RAM 62.

The nonvolatile memory 64 (NVM) is a rewritable nonvolatile memory. For example, the NVM 64 stores the control program executed by the printer CPU 61 and control data. The NVM 64 may store setting information and processing conditions, or the like.

The transport controller 65 controls the paper transport in the printer 2. The transport controller 65 controls driving of the pick-up roller 21 and the transport roller provided in the transport path 22*a*. The transport controller 65 controls driving of the transport roller in the printer 2 according to the operation instructions from the printer CPU 61. For example, the printer CPU 61 instructs the transport controller 65 to begin feeding the sheet with the pick-up roller 21 and the transport roller according to the instruction to begin image formation processing from the system controller 5.

The scanner 1 reads the image of the original document according to the operation instructions from the system CPU 51. The image data read by the scanner 1 is transmitted to the system controller 5. The system controller 5 saves the image data read by the scanner 1 to the HDD 55.

The exposure controller 70 receives commands by the printer CPU 61, and controls the exposure unit 26. That is, the exposure controller 70 forms an electrostatic latent image on the photoreceptor drums of the respective image forming units 25Y, 25M, 25C, and 25K with the exposure unit 26 according to the operation instructions from the printer CPU 61. For example, the exposure controller 70 controls the laser light the exposure unit 26 irradiates each photoreceptor drum with according to the image data instructed by the printer CPU 61.

The image formation controller 71 receives commands by the printer CPU 61, and controls driving of each image forming unit 25Y, 25M, 25C, and 25K. That is, the image formation controller 71 develops the electrostatic latent image formed on the photoreceptor drum of each image forming unit 25Y, 25M, 25C, and 25K according to the operation instructions from the printer CPU 61 with each color of toner.

The transfer controller 73 receives commands by the printer CPU 61, and controls driving of the transfer unit 28 and the transfer current or the like. That is, the transfer controller 73 transfers the toner image transferred to the intermediate transfer belt 27 to a sheet with the transfer unit 28 according to the operation instructions from the printer CPU 61.

The fixing controller 75 receives commands by the printer CPU 61, and controls the driving of the fixing device 29. That is, the fixing controller 75 drives the heat roller 29*b* and the pressure roller 29*c* according to the operation instruction from the printer CPU 61. The fixing controller 75 receives commands by the printer CPU 61, and controls the surface temperature of the heat roller 29*b*to a desired temperature by controlling the heating unit 29*a*. In other words, the fixing controller 75 controls the surface temperature of the heat roller 29*b* to the temperature (e.g., the fixing temperature) designated by the printer CPU 61.

The reversal controller 76 receives commands by the printer CPU 61, and controls the driving of the ADU 31. That is, the reversal controller 76 resupplies the sheet passing through the fixing device 29 to the front of the image reading position of the scanner 1 with the ADU 31 according to the operation instructions from the printer CPU 61. For example, when forming an image on the rear surface of a sheet subjected to the fixing process (when performing duplex printing), the reversal controller 76 switches back the sheet after fixing processing to be picked up by the ADU 31 after being transported temporarily to the discharge unit 30 side. The ADU 31 re-supplies the sheet switched back by the discharge unit 30 to the front of the resist roller 24. In so doing, the sheet is re-supplied to the resist roller 24 in a reversed state.

The printer CPU 61 stores setting information with respect to each paper cassette 20 in the NVM 54. The setting information of each paper cassette, for example, includes the size of the supplied (accommodated) sheet and the sheet type (ordinary paper, envelope, thick paper or the like) or the like. The sheet size may be set by a sensor, or the like, provided in each paper cassette 20. The sheet type is set by a user or manager via the operation panel 4.

Figure 3:
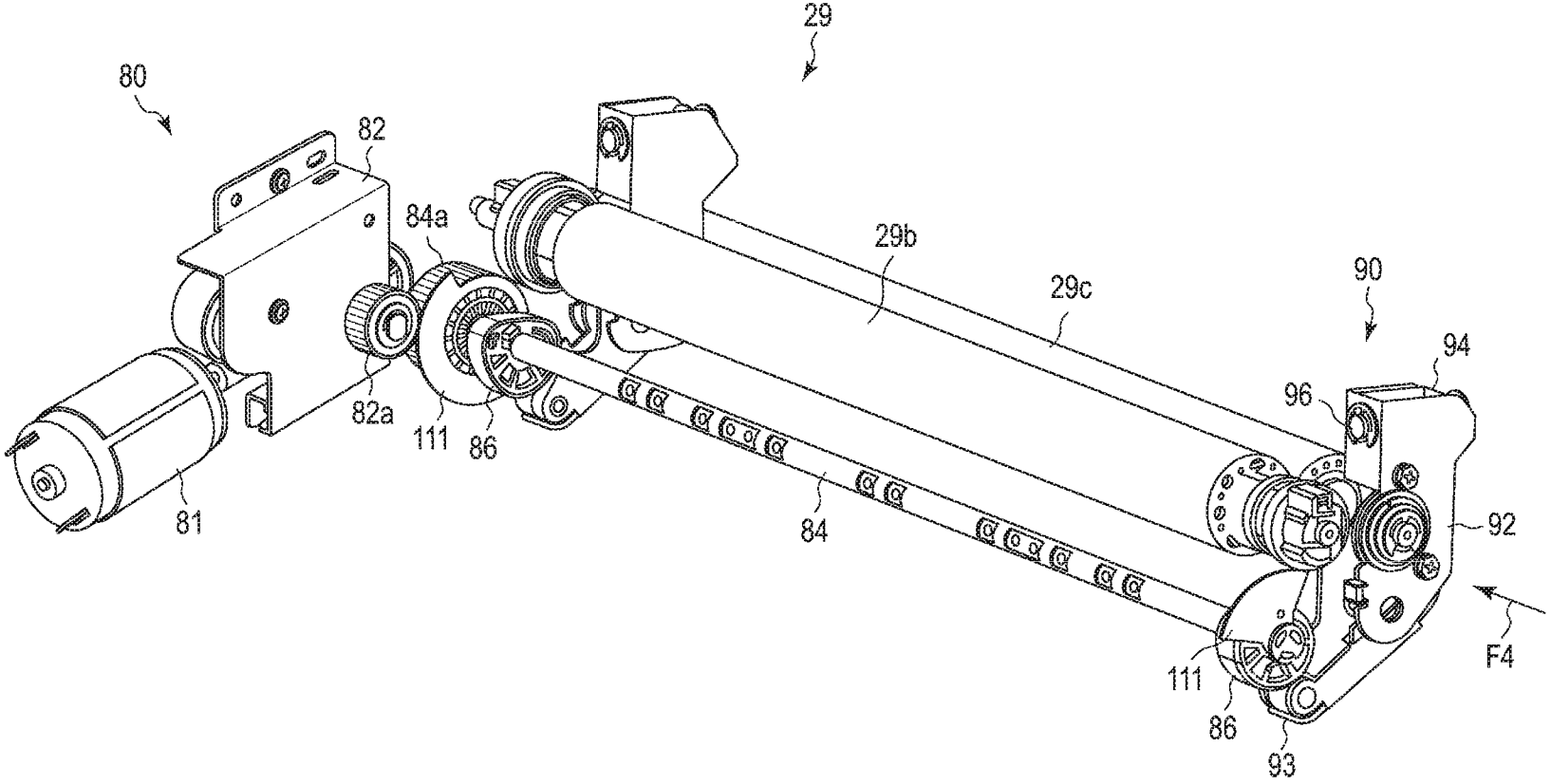
FIG. 3 is a perspective view of a contact and separation mechanism of a fixing device installed in the image forming apparatus.
Figure 4:
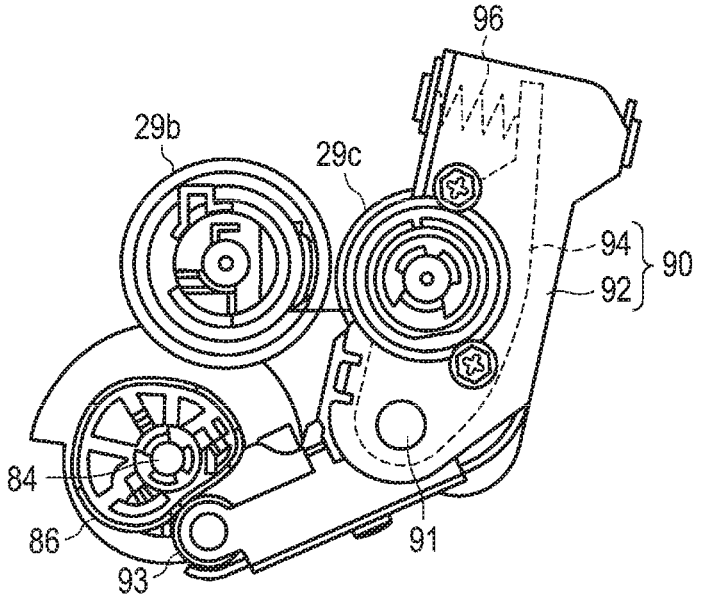
FIG. 4 is a side view of the contact and separation mechanism in FIG. 3 seen from the direction of the arrow F4.
Figure 5:
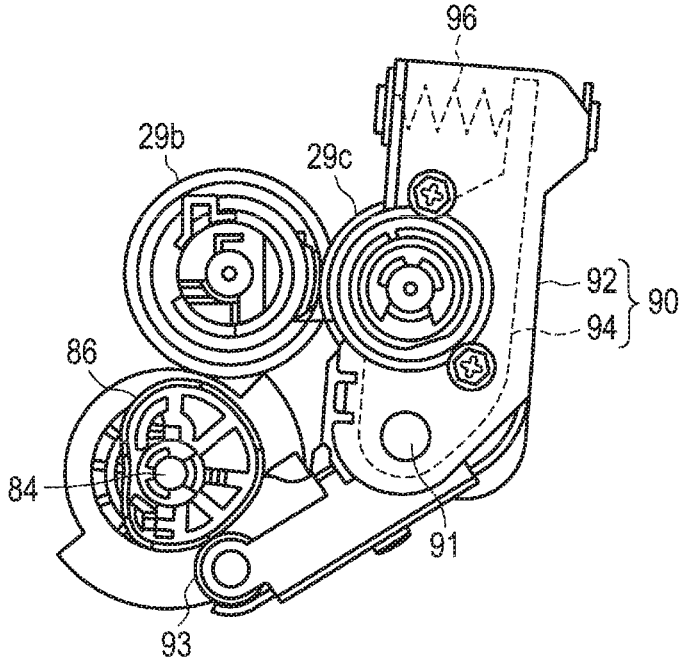
FIG. 5 is a side view illustrating a state in which the pressure roller in FIG. 4 is disposed at a semi-contact position.
Figure 6:
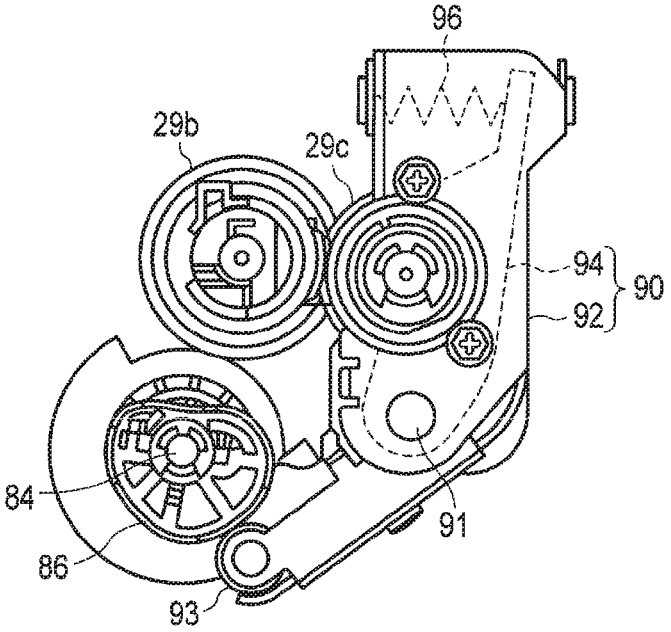
FIG. 6 is a side view illustrating a state in which the pressure roller in FIG. 4 is disposed at the contact position.

Next, the contact and separation mechanism of the fixing device 29 installed in the printer 2 will be described with reference to FIGS. 3 to 6. FIG. 3 is a perspective view of the contact and separation mechanism. FIG. 4 is a side view of the main portions of the fixing device 29 taken along the arrow F4 in FIG. 3. FIG. 5 is a side view of a state in which the pressure roller 29*c* is disposed at a semi-contact position. FIG. 6 is a side view of a state in which the pressure roller 29*c* is disposed at a contact position.

The fixing device 29 includes a heat roller 29*b* and a pressure roller 29*c* that face each other. The heat roller 29*b* and the pressure roller 29*c* each extend from the rear side of the digital composite device toward the front side (direction substantially orthogonal to the paper surface in FIG. 1), and extend in substantial parallel to each other. The above-described heating unit 29*a* (FIG. 1) is disposed inside the heat roller 29*b*.

The fixing device 29 includes a movement mechanism 80 that causes the pressure roller 29*c* to come into contact with and separate from the heat roller 29*b*. The movement mechanism 80 causes the pressure roller 29*c* to abut on the heat roller 29*b* with a predetermined pressing force (first pressing force) and causes the pressure roller 29*c* to move to the contact position (position shown in FIG. 6) forming a nip between both rollers. The movement mechanism 80 also moves the pressure roller 29*c* to the separation position (position shown in FIG. 4) at which the pressure roller 29*c* is at least separated from the heat roller 29*b*. The movement mechanism 80 also moves the pressure roller 29*c* to the semi-contact position (position shown in FIG. 5) at which the pressure roller 29*c* is brought into contact with the heat roller 29*b* at a second pressing force lower than the first pressing force.

As illustrated in FIG. 1, the sheet is transported to the nip position by the transport path 22*a*.

For example, when a normal type of sheet (ordinary paper) is input as setting information by a user via the operation panel 4, the movement mechanism 80 positions the pressure roller 29*c* at the contact position. For example, when a special type of sheet (envelop or special medium) is input as setting information by a user via the operation panel 4, the movement mechanism 80 disposes the pressure roller 29*c* at the semi-contact position.

The term "contact" indicates a state in which the pressure roller 29*c* is pressed to the heat roller 29*b* at the first pressing force, and the pressure roller 29*c* and the heat roller 29*b* are in contact. The term "semi-contact" indicates a state in which the pressure roller 29*c* is pressed to the heat roller 29*b* with the second pressing force smaller than the first pressing force, and the pressure roller 29*c* and the heat roller 29*b* are in contact. The special type of medium may be a clear file, a paper file, a thin paper not easily wrinkled, or the like.

Both ends of the rotary shaft of the heat roller 29*b* are supported to be rotatable by a fixing frame, not illustrated, of the fixing device 29. Meanwhile, both ends of the rotary shaft of the pressure roller 29*c* are held to be rotatable by a holding arm 90 (holding member). The two holding arms 90 cause the pressure roller 29*c* to come in contact with and separate from the heat roller 29*b* by rotating with respect to the fixing frame, not illustrated, with the rotary shaft 91 as a center. Because the holding arms 90 provided at both ends of the pressure roller 29*c* have the same structure, only the holding arm 90 on the right side in FIG. 3 will be described as representative.

The holding arm 90 includes an arm main body 92 including a cam follower 93 on one end, and a movable arm 94 attached with respect to the arm main body 92 to be rotatable. The arm main body 92 constantly biases the cam follower 93 in a pressing direction to a cam 86 described later by a spring or the like (not illustrated). The movable arm 94 holds both ends of the rotary shaft of the pressure roller 29*c* to be rotatable.

The arm main body 92 is attached to the fixing frame (not illustrated) of the fixing device 29 via the above-described rotary shaft 91. The movable arm 94 is attached to the arm main body 92 in a rotatable state with the rotary shaft 91 as a center. One end of the compression spring 96 (pressing member) disposed with respect to the arm main body 92 is attached to the side separated from the rotary shaft 91 of the movable arm 94.

Therefore, the compression spring 96 is greatly compressed in a state in which the pressure roller 29*c* is disposed at the contact position illustrated in FIG. 6, and the pressure roller 29*c* is pressed to the heat roller 29*b* at a comparatively strong pressing force (first pressing force). Because the compression spring 96 is slightly compressed in a state in which the pressure roller 29*c* is disposed at the semi-contact position illustrated in FIG. 5, the pressure roller 29*c* is pressed to the heat roller 29*b* with a comparatively weak pressing force (second pressing force).

In other words, the compression spring 96 is compressed by a distance in accordance with the rotation displacement amount with respect to arm main body 92 of the movable arm 94 when the pressure roller 29*c* is pressed to the heat roller 29*b*. The pressure roller 29*c* is elastically pressed to the heat roller 29*b* according to the recovery force of the spring in the compressed state. That is, the pressing force due to the compression spring 96 is generated at the point in time at which the pressure roller 29*c* at least contacts the heat roller 29*b*.

The movement mechanism 80 moves the cam follower 93 of the above-described pair of holding arms 90, and causes the pressure roller 29*c* to contact and separate from the heat roller 29*b* by causing the pair of holding arms 90 to rotate. The movement mechanism 80 includes a DC motor 81, a gear box 82, a cam shaft 84, and cams 86, as illustrated in FIG. 3.

The DC motor 81 is rotatable in both the forward and reverse directions. The gearbox 82 includes a plurality of gears (partially not illustrated) meshed with one another, and decelerates the rotation of the DC motor 81 and transfers the rotation to the gear 82*a*, via the plurality of gears.

The cam shaft 84 is disposed in substantially parallel with the heat roller 29*b* and the pressure roller 29*c*, and includes a cam 86 at both ends thereof. The two cams 86 are attached to both ends of the cam shaft 84 with the same posture. The two cams 86 are rotation plates with the peripheral surface (cam surface) deformed, and disposed so that each cam surface contacts the cam follower 93 of the holding arm 90.

A gear 84*a* that meshes with a gear 82*a* is attached to one end (end portion of the right side in the drawing) of the cam shaft 84. Thus, the cams 86 provided on both ends of the cam shaft 84 rotate in both the forward and reverse directions according to the rotation of the DC motor 81. The cam 86 changes the distance between the side of the cam surface contacted by the cam follower 93 and the center of rotation of the cam 86 by rotating, and the cam follower 93 is moved based on the change in the distance.

More specifically, when the cam 86 is rotated to the position illustrated in FIG. 4, the distance between the center of rotation of the cam 86 and the contact position with respect to the cam follower 93 becomes the shortest, the holding arm 90 rotates in the state illustrated in the drawing, and the pressure roller 29*c* is disposed at the separation position. When the cam 86 is rotated to the position illustrated in FIG. 6, the distance between the center of rotation of the cam 86 and the contact position with respect to the cam follower 93 becomes the longest, the holding arm 90 rotates in the state illustrated in the drawing, and the pressure roller 29*c* is disposed at the contact position. Furthermore, when the cam 86 is rotated to the position illustrated in FIG. 5, the distance between the center of rotation of the cam 86 and the contact position with respect to the cam follower 93 becomes an intermediate length, the holding arm 90 rotates in the state illustrated in the drawing, and the pressure roller 29*c* is disposed at the semi-contact position.

For example, when the pressure roller 29*c* is moved to the semi-contact position illustrated in FIG. 5 from the separation position illustrated in FIG. 4, the movement mechanism 80 rotates the cam 86 in the clockwise direction illustrated in the drawing. For example, it is possible for the cam 86 to be rotated in the counter-clockwise direction illustrated in the drawings from the state in FIG. 4, and for the pressure roller 29*c* to be moved from the separation position to the contact position in FIG. 6. In particular, the cam 86 may be rotated in the clockwise direction illustrated in the drawing when the pressure roller 29*c* is moved from the semi-contact position in FIG. 5 to the contact position in FIG. 6, and the cam 86 may be rotated in the counter-clockwise direction illustrated in the drawing when the pressure roller 29*c* is moved from the semi-contact position in FIG. 5 to the separation position in FIG. 4.

Figure 7:
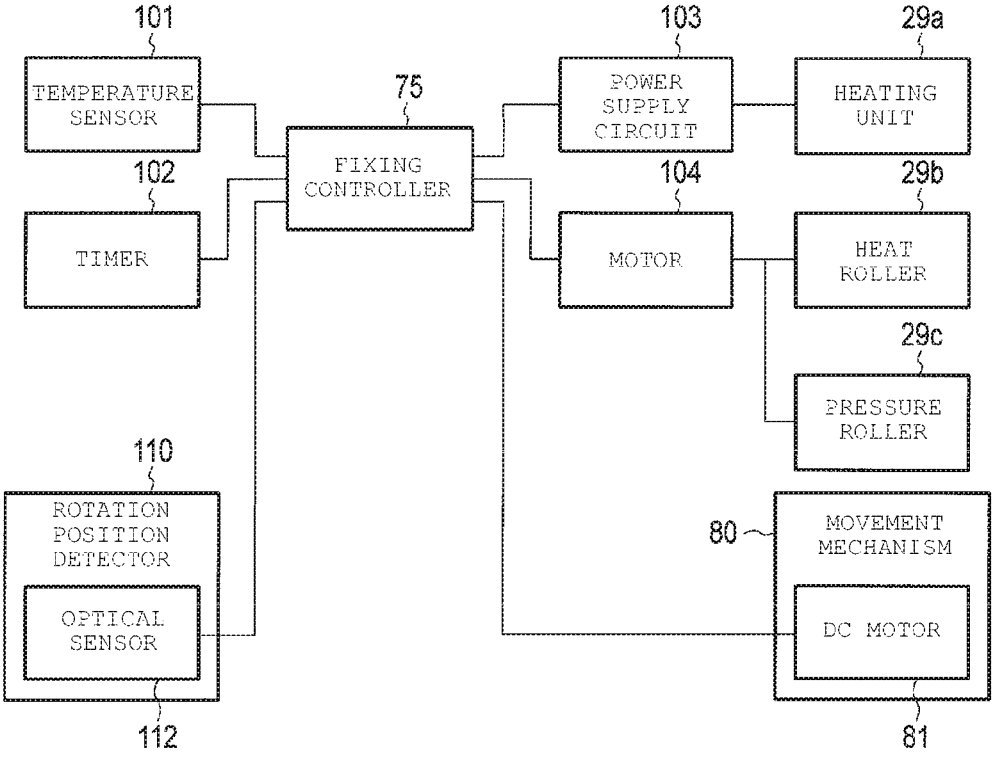
FIG. 7 is a block diagram of a control system of the fixing device.

Next, the control system that controls the operation of the fixing device 29 with the above structure will be described with reference to the block diagram illustrated in FIG. 7.

A temperature sensor 101 for detecting the surface temperature of the heat roller 29*b* and a timer 102 for managing the time are connected to the fixing controller 75 (below, simply referred to as a controller 75). A feeder circuit 103 that supplies power to the heating unit 29*a* of the heat roller 29*b*, the motor 104 which rotates the heat roller 29*b* and the pressure roller 29*c* in the transport direction of the sheet, the DC motor 81 of the above-described movement mechanism 80, and a rotation position detector 110 for detecting the rotation position of the cam 86 are connected to the controller 75.

A rotation position detector 110 is provided at both ends of the cam shaft 84. The rotation position detector 110 includes a light blocking plate 111 fixed to the end portion of the cam shaft 84 and an optical sensor 112 that detects a notch in the light blocking plate 111. The rotation position detector 110 includes an optical sensor 112 that rotates along with the cam shaft 84 and in which the optical axis is blocked by the light blocking plate 111, and detects the rotation position of the cam 86 by a light and dark signal of the optical sensor 112.

Figure 8:
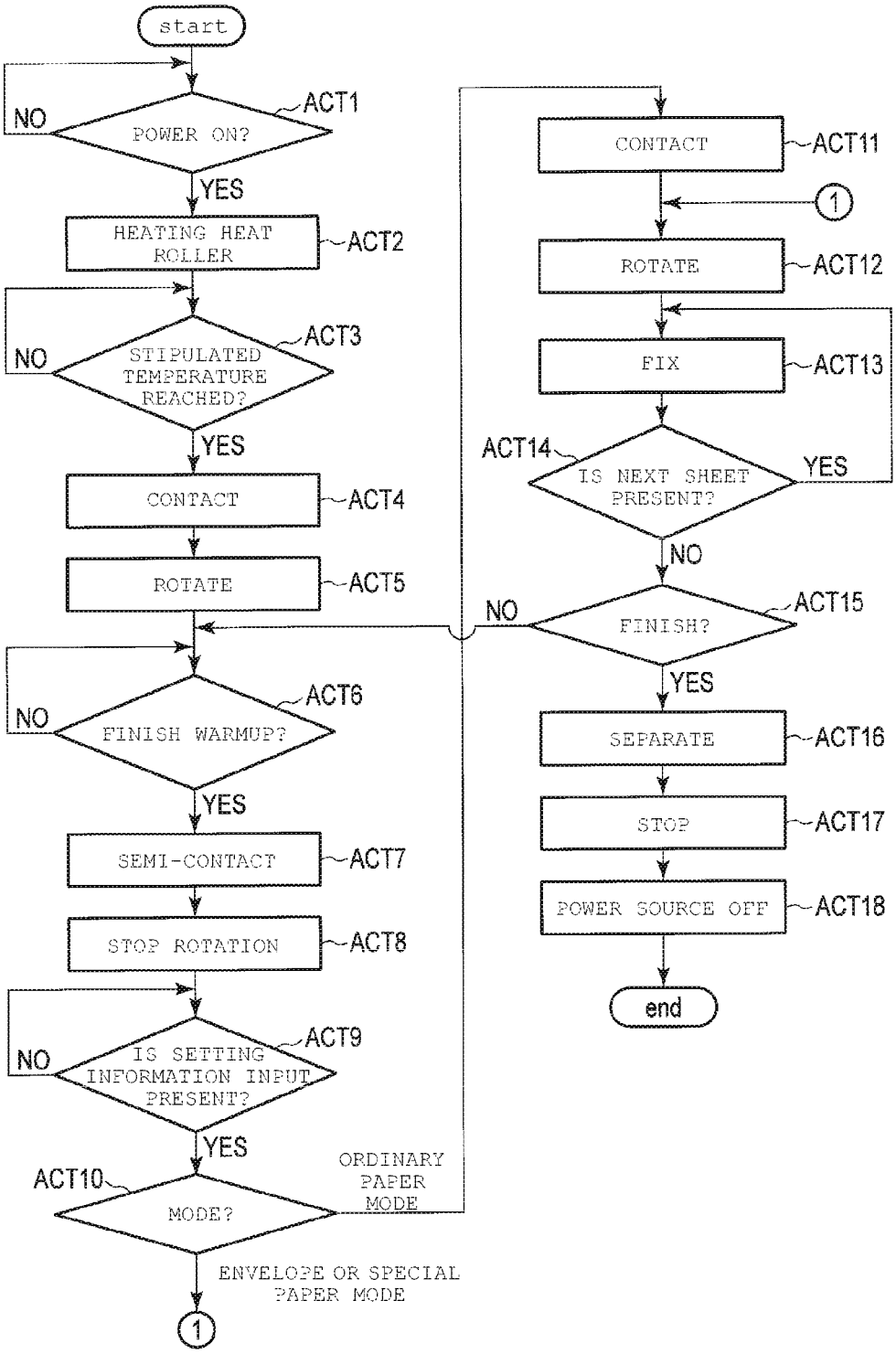
FIG. 8 is a flowchart setting forth an example sequence of operations of the fixing device.

Next, the operation of the fixing device 29 with the above structure will be described with reference to the flowchart in FIG. 8.

When the power source of the digital composite device is turned on by a user via the operation panel 4 (ACT 1: YES), the controller 75 controls the feeder circuit 103, and begins the power supply to the heating unit 29*a* of the heat roller 29*b* (ACT 2). When the power is OFF, the pressure roller 29*c* is disposed at the separation position in order to prevent from being left as is for a long time in a state in which the pressure roller 29*c* is pressed to the heat roller 29*b*. Thereby, roller creep by the heat roller 29*b* and the pressure roller 29*c* is prevented.

After the power source is turned ON, the controller 75 monitors the output of the temperature sensor 101, and determines whether or not the surface temperature of the heat roller 29*b* reaches the predetermined temperature (ACT 3). The stipulated temperature in this case is a temperature close to the fixing temperature. When the surface temperature of the heat roller 29*b* reaches the predetermined temperature (ACT 3; YES), the controller 75 forward rotates (second direction) the DC motor 81 of the movement mechanism 80, moves the pressure roller 29*c* from the separation position to the contact position (ACT 4), controls the motor 104, and the heat roller 29*b* and the pressure roller 29*c* are slowly rotated (ACT 5). The contact timing of the pressure roller 29*c* after power is turned on may be managed using the timer 102.

Thereafter, the controller 75 monitors the surface temperature of the heat roller 29*b* using the temperature sensor 101, and determines whether the fixing device 29 is completely warmed up to the fixing temperature (ACT 6). When it is determined that the warm up (preheating) is finished in ACT 6 (ACT 6; YES), the controller 75 temporarily stops the power supply with respect to the heating unit 29*a*, again slightly forward rotates the DC motor 81, moves the pressure roller 29*c* from the contact position to the semi-contact position (ACT 7), and stops the rotation of the heat roller 29*b* and the pressure roller 29*c* by stopping the motor 104 (ACT 8). This state becomes the standby state awaiting the fixing operation.

The controller 75 monitors the temperature of the fixing device 29 via the temperature sensor 101 while a sheet is fed to the fixing device 29, after the pressure roller 29*c* is disposed at the semi-contact position and stopped in ACT 8. When the temperature of the fixing device 29 drops below a threshold set in advance, the heat roller 29*b* and the pressure roller 29*c* are again rotated and power is supplied to the heating unit 29*a*. After the temperature of the fixing device 29 reaches the fixing temperature, the heat roller 29*b* and the pressure roller 29*c* are stopped and the power supply to the heating unit 29*a* is paused. In this way, the controller 75 controls the temperature of the fixing device 29 in the standby state to the fixing temperature.

In the standby state in ACT 8, when setting information relating to the type of sheet (ordinary paper, envelope, special paper or the like) is input by a user via the operation panel 4 (ACT 9; YES), the controller 75 determines the paper feeding mode in accordance with the type of sheet (ACT 10).

When the sheet type designated by the user is ordinary paper and the image forming mode (ordinary paper mode) is determined with respect to the ordinary paper in ACT 10, the controller 75 reversely rotates (first direction) the DC motor 81 of the movement mechanism 80, and moves the pressure roller 29*c* from the semi-contact position to the contact position (ACT 11), controls the motor 104, and rotates the heat roller 29*b* and the pressure roller 29*c* (ACT 12).

In this state, when the sheet is fed to the fixing device 29 via the transport path 22*a*, the sheet passes through the nip between the heat roller 29*b* and the pressure roller 29*c*, and the toner transferred onto the sheet is heated and melted, thereby being fixed to the sheet (ACT 13). At this time, the pressing force applied to the sheet by the pressure roller 29*c* is optimized according to the thickness of the sheet (ordinary paper) by disposing the pressure roller 29*c* at the contact position. Therefore, the toner is normally fixed to the sheet.

When the fixing operation for a predetermined number of sheets feed in the task is finished (ACT 14; NO), the controller 75 transitions to the process of ACT 6 to await the next task (ACT 15; NO). Because the temperature of the fixing device 29 lowers each time a sheet passes through, time is taken for preheating.

Meanwhile, when the sheet type designated by the user in ACT 9 is a thicker sheet than ordinary paper, such as an envelope or special paper, and the image forming mode (envelope or special paper mode) is determined with respect to the envelop or special paper in ACT 10, the controller 75 controls the motor 104, and rotates the heat roller 29*b* and the pressure roller 29*c* (ACT 12).

In this state, when the sheet is fed to the fixing device 29 via the transport path 22*a*, the sheet passes through the nip between the heat roller 29*b* and the pressure roller 29*c*, and the toner transferred onto the sheet is heated and melted, thereby being fixed to the sheet (ACT 13). At this time, the pressing force applied to the sheet by the pressure roller 29*c* is optimized according to the thickness of the sheet (envelope, special paper) by leaving the pressure roller 29*c* as is at the semi-contact position, and thus, the sheet is normally transported.

When the fixing operation for a predetermined number of sheets feed in the task is finished (ACT 14; NO), the controller 75 transitions to the process of ACT 6 to await the next task (ACT 15; NO).

When the controller 75 determines that the fixing operation is finished in ACT 15, the DC motor 81 of the movement mechanism 80 is forward rotated (second direction), and the pressure roller 29*c* moves to the separation position (ACT 16). That is, when the final task before finishing is executed in the ordinary paper mode, the controller 75 moves the pressure roller 29*c* from the contact position through the semi-contact position to the separation position, and when the final task before finishing is executed in the envelope or special paper mode, moves the pressure roller 29*c* from the semi-contact position to the separation position.

Thereafter, the controller 75 stops the rotation of the motor 104, stops the rotation of the heat roller 29*b* and the pressure roller 29*c* (ACT 17), and shuts OFF the power source of the apparatus (ACT 18), thereby finishing the process.

For example, when an abnormality such as a paper jam occurs during the image formation operation with respect to the ordinary paper, the controller 75 reversely rotates the DC motor 81 of the movement mechanism 80 in the first direction, the pressure roller 29*c* is able to directly move from the contact position to the separation position in order to prevent roller creep between the heat roller 29*b* and the pressure roller 29*c* along with ensuring ease of maintenance with respect to the fixing device 29. In this case, although load fluctuation of the pressure roller 29*c* between before movement and after movement becomes larger and the operation sound becomes louder since it does not pass through the semi-contact position, the time necessary for movement of the pressure roller 29*c* is shortened.

When the standby state in ACT 8 described above continues for a predetermined time, the controller 75 transitions to a power saving mode (sleep state), and the pressure roller 29*c* disposed at the semi-contact position is able to move to the separation position.

According to the image forming apparatus according to an embodiment described above, it is possible to lower the operation sound of the fixing device by arranging the pressure roller 29*c* at the semi-contact position in the standby state after warm up finishes.

That is, when the pressure roller 29*c* is disposed at the semi-contact position in the standby state of the fixing operation, it is possible to reduce load fluctuation when arranging to the contact position, and reduce the operation sound of the apparatus accordingly compared to when moving the pressure roller 29*c* from the separation position to the contact position. Also when arranging the pressure roller 29*c* at the separation position, it is possible to reduce the load fluctuation when being moved from the semi-contact position to the separation position, and to lower the operation sound compared to when being moved from the contact position to the separation position.

According to an embodiment, in the standby state in ACT 8, because the rotation of the heat roller 29*b* and the pressure roller 29*c* is stopped in the state in which the pressure roller 29*c* is disposed at the semi-contact position, it is possible to make the traveling distance of the fixing device 29 zero after weakening the pressing force during contact, and to improve the service life of the fixing device 29.

Furthermore, according to an embodiment, when forming an image on a special medium, such as an envelope or a file, it is possible to execute the fixing operation in a state (as is in the standby state) where the pressure roller 29*c* is disposed as is in the semi-contact position in the standby state in ACT 8, moving the pressure roller 29*c* becomes unnecessary, and the operation sound due to movement of the pressure roller 29*c* does not occur.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

For example, in the above-described embodiment, although the stop positions of the pressure roller 29*c* by the cam 86 are set to the three positions of the contact position, the semi-contact position, and the separation position, there is no limit thereto, and a plurality of stop positions maybe provided between the contact position and the separation position. In this case, for example, in addition to the semi-contact position, it is possible to set a standby position at which the pressure roller 29*c* contacts the heat roller 29*b*, and to set the pressing force applied to the heat roller 29*b* from the pressure roller 29*c* to zero when in the standby state.

What is claimed is:

1. An image forming apparatus comprising:

a fixing device including:

a heat unit, a pressure unit that is moveable with respect to the heat unit, and a movement mechanism that moves the pressure unit among a contact position in which the pressure unit contacts the heat unit with a first pressing force, a separation position in which the pressure unit does not contact the heat unit, and a semi-contact position in which the pressure unit contacts the heat unit with a second pressing force smaller than the first pressing force; and a controller configured to control the movement mechanism to move the pressure unit from the semi-contact position to the separation position after the pressure unit is in the semi-contact position for more than a predetermined time.

2. The apparatus of claim 1, wherein the controller further controls the movement mechanism so that the pressure unit is at the contact position when the heat unit is being heated to a predetermined temperature.

3. The apparatus of claim 1, wherein the controller further controls the movement mechanism so that the pressure unit is moved from the contact position to the semi-contact position after a temperature of the heat unit is equal to or greater than the predetermined temperature or after a second predetermined time has elapsed.

4. The apparatus of claim 1, wherein the movement mechanism further includes:

a holding member that rotatably supports a rotating shaft of the pressure unit, a motor configured to rotate a cam in forward and backward directions, and a cam follower that is displaced due to rotation of the cam and correspondingly displaces the holding member, and the controller rotates the motor in a first direction so that the pressure unit moves from the semi-contact position to the contact position, and rotates the motor in a second direction opposite to the first direction so that the pressure unit is moved from the semi-contact position to the contact position.

5. The apparatus of claim 4, wherein the holding member further includes a pressing member that elastically presses the pressure unit towards the heat unit.

6. The apparatus of claim 5, wherein the controller is configured to operate the movement mechanism in a first mode, in which the pressure unit moves through the semi-contact position when the pressure unit is moved from the contact position to the separation position, and in a second mode, in which the pressure unit moves directly from the contact position to the separation position without passing through the semi-contact position when the pressure unit is moved from the contact position to the separation position.

7. The apparatus of claim 1, wherein the controller stops rotation of the pressure unit and the heat unit in the standby state after the pressure unit is positioned at the semi-contact position.

8. The apparatus of claim 1, wherein the second pressing force is approximately zero.

9. A method of controlling a fixing device comprising the steps of:

heating a heat unit to a predetermined temperature;

while the heat roller is being heated to the predetermined temperature, rotating a pressure unit that is configured to be moved between a contact position in which the pressure unit contacts the heat unit with a first pressing force, a separation position in which the pressure unit does not contact the heat unit, and a semi-contact position in which the pressure unit contacts the heat unit with a second pressing force different than the first pressing force;

positioning the pressure unit at the semi-contact position after the heat unit is heated to the predetermined temperature; and moving the pressure unit from the semi-contact position to the separation position after the pressure unit has been in the semi-contact position for more than a predetermined time.

10. The method of claim 9, wherein the pressure unit is at the contact position when the heat unit is being heated to the predetermined temperature.

11. The method of claim 10, wherein the positioning step comprises moving the pressure unit from the contact position to the semi-contact position.

12. The method of claim 9, further comprising the step of:

stopping rotation of the pressure unit after the pressure unit is moved to the semi-contact position and after the heat unit is heated to the predetermined temperature.

13. The method of claim 9, wherein the second pressing force is smaller than the first pressing force.

14. The method of claim 9, further comprising the step of:

moving the pressure unit from the semi-contact position to the contact position before transporting a medium between the heat unit and the pressure unit.

15. The method of claim 14, further comprising the step of:

moving the pressure unit from the contact position to the separation position via the semi-contact position after a fixing operation on the medium is completed.

16. The apparatus of claim 14, wherein the movement mechanism further includes:

a holding member that rotatably supports a rotating shaft of the pressure unit, a motor configured to rotate a cam in forward and backward directions, and a cam follower that is displaced due to rotation of the cam and correspondingly displaces the holding member, and the controller rotates the motor in a first direction so that the pressure unit moves from the semi-contact position to the contact position, and rotates the motor in a second direction opposite to the first direction so that the pressure unit is moved from the semi-contact position to the contact position.

17. The method of claim 9, wherein the second pressing force is approximately zero.

18. The method of claim 9, further comprising the step of:

maintaining the heat unit at the predetermined temperature while the pressure unit is positioned at the semi-contact position.

19. An image forming apparatus comprising:

an image forming unit configured to form a toner image on a medium;

a fixing device configured to fix the toner image on the medium, the fixing device including:

a heat unit, a pressure unit that is moveable with respect to the heat unit, and a movement mechanism that moves the pressure unit among a contact position in which the pressure unit contacts the heat unit with a first pressing force, a separation position in which the pressure unit does not contact the heat unit, and a semi-contact position in which the pressure unit contacts the heat unit with a second pressing force smaller than the first pressing force; and a controller configured to control the movement mechanism to move the pressure unit from the semi-contact position to the separation position after the pressure unit is in the semi-contact position for more than a predetermined time.

20. The apparatus of claim 19, wherein the controller further controls the movement mechanism so that the pressure unit is at the contact position when the heat unit is being heated to a predetermined temperature.

* * * * *